US006752729B1

(12) United States Patent
Huang

(10) Patent No.: US 6,752,729 B1
(45) Date of Patent: Jun. 22, 2004

(54) CONNECTION MEMBER FOR CONNECTING PARTS OF FRAME ASSEMBLY

(76) Inventor: Kuang-Hui Huang, No. 91, AI Guo St., Feng Yuan City (TW)

( * ) Notice: Subject to any disclaimer, the term of this patent is extended or adjusted under 35 U.S.C. 154(b) by 0 days.

(21) Appl. No.: 10/331,443

(22) Filed: Dec. 27, 2002

(51) Int. Cl.[7] ..... A63B 63/00
(52) U.S. Cl. ..... 473/476; 473/478; 403/91
(58) Field of Search ..... 473/476, 477, 473/478, 483; 403/377, 108, 109.3, 91

(56) References Cited

U.S. PATENT DOCUMENTS 3,642,282 A * 2/1972 Frischman ..... 473/478
3,947,140 A * 3/1976 Thomas ..... 403/108
4,247,216 A * 1/1981 Pansini ..... 403/109.3
4,858,633 A * 8/1989 Yang ..... 135/25.4
5,080,375 A * 1/1992 Moosavi ..... 473/478
5,387,048 A * 2/1995 Kuo ..... 403/109.3
5,539,957 A * 7/1996 Schmidt ..... 16/331
5,599,024 A * 2/1997 Acuff et al. ..... 473/478

* cited by examiner

*Primary Examiner*—Gregory Vidovich
*Assistant Examiner*—M. Chambers
(74) *Attorney, Agent, or Firm*—Charles E. Baxley

(57) ABSTRACT

A frame includes a plurality of L-shaped elbow members and tubes. Each elbow member includes two extension tubes and each extension tube has an open end and a hole is defined through a wall proximate to the open end. Each tube includes two open ends so as to be inserted into the open ends of the extension tubes of the elbow members. Each open end of each of the tubes has a hole defined through a wall proximate to the open ends. A C-shaped connection member is biased in the open end of each tube and has a protrusion which is inserted in the aligned holes of the tubes and the extension tubes.

4 Claims, 6 Drawing Sheets

CONNECTION MEMBER FOR CONNECTING PARTS OF FRAME ASSEMBLY

FIELD OF THE INVENTION

The present invention relates to a frame assembly that includes a plurality of sections connected with each other head-to-tail. Each section has a hole and a C-shaped member is received in the overlapped part of the two connected sections and a protrusion on the C-shaped member is inserted in the aligned holes.

BACKGROUND OF THE INVENTION

A conventional goal frame in sport games generally includes a frame and a net is connected to the frame. The frame is made of several metal tubes which are welded with each other so as to become a desired shape and size. Nevertheless, the frame composed of the metal tubes are bulky and heavy so that it is inconvenient to be stored and carried. Some manufacturers develop a frame assembly that can be assembled by several sections so that the users may detach the frame into sections which are convenient for storage. One of the types of the connection of the frame is to insert a narrow end of a section into a larger end of another section. Although the frame can be assembled quickly, the connection portion is often disconnected from each other because the connection portion could be separated by impact.

The present invention intends to provide a frame that is composed of several sections and a C-shaped member is received in each connection portion of two sections. The C-shaped member has a protrusion which is inserted in aligned holes of the two sections.

SUMMARY OF THE INVENTION

In accordance with one aspect of the present invention, there is provided a frame assembly which comprises two top elbow members, two front elbow members and two rear elbow members. Two sections are respectively connected between the two top elbow members and the two rear elbow members. Two tubes are connected between the top elbow members and the two front elbow members. Two tubes are connected between the front elbow members and the two rear elbow members. A plurality of C-shaped connection members are respectively biased in the two ends of the tubes and each connection member has a protrusion which extends through aligned holes defined through the extension tubes of the elbow members and the tubes.

The primary object of the present invention is to provide a frame assembly that is composed by elbow members and tubes by several C-shaped connection members. The connection members are biased in the tubes and each have a protrusion which extends through aligned holes in the elbow members and tubes.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
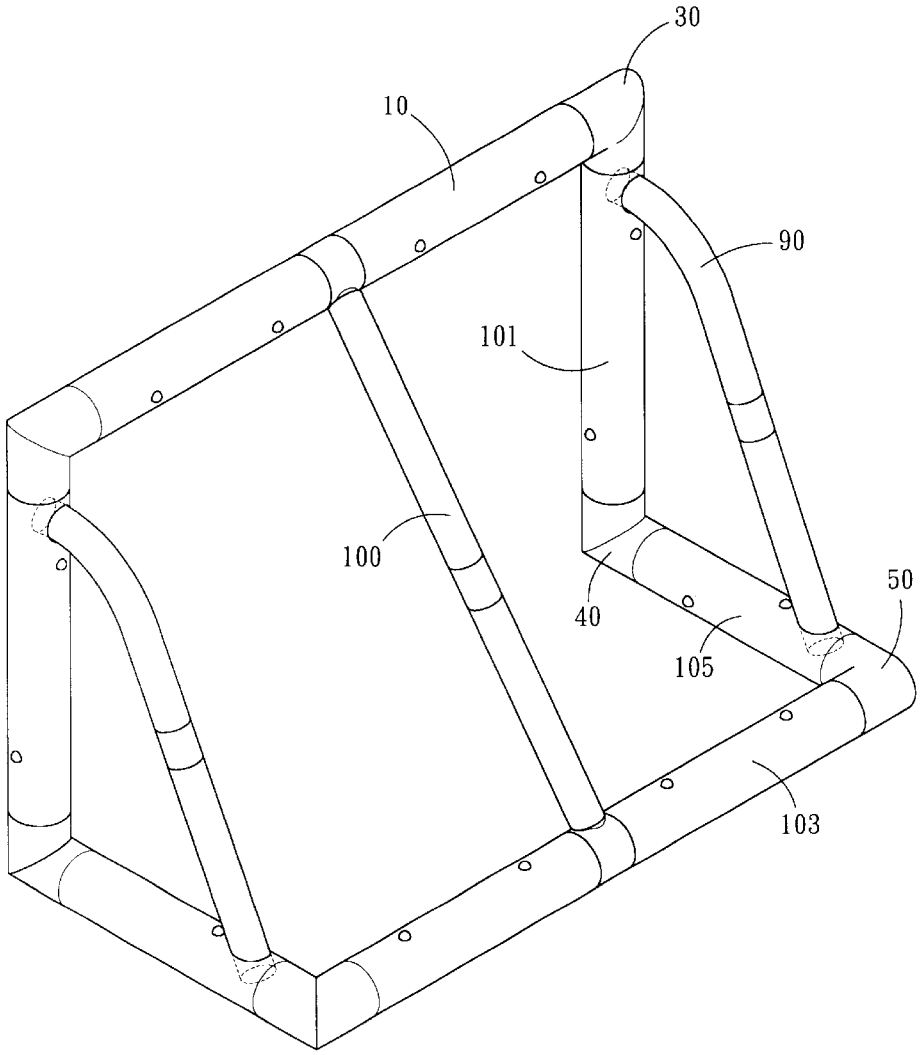
FIG. 1 is a perspective view to show the frame assembly of the present invention.
Figure 2:
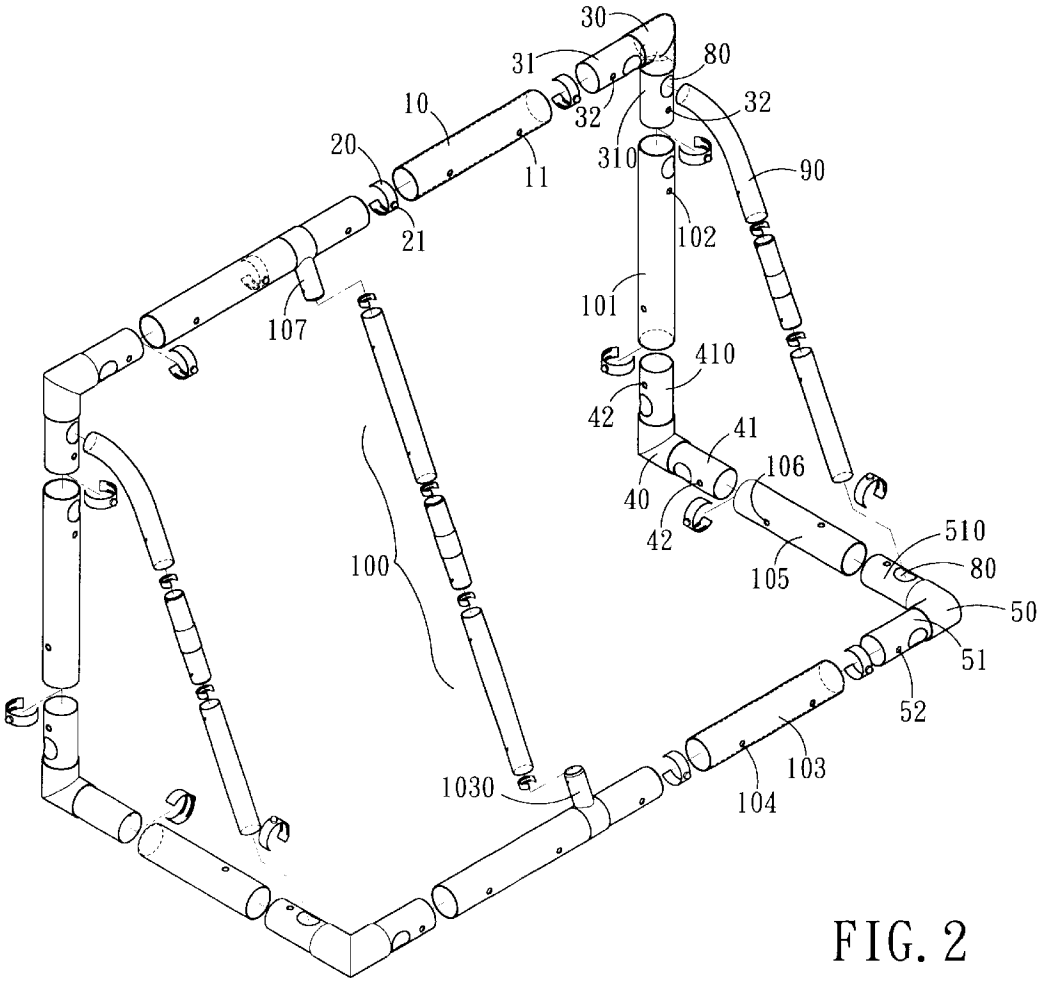
FIG. 2 is an exploded view to show the frame assembly of the present invention.
Figure 3:
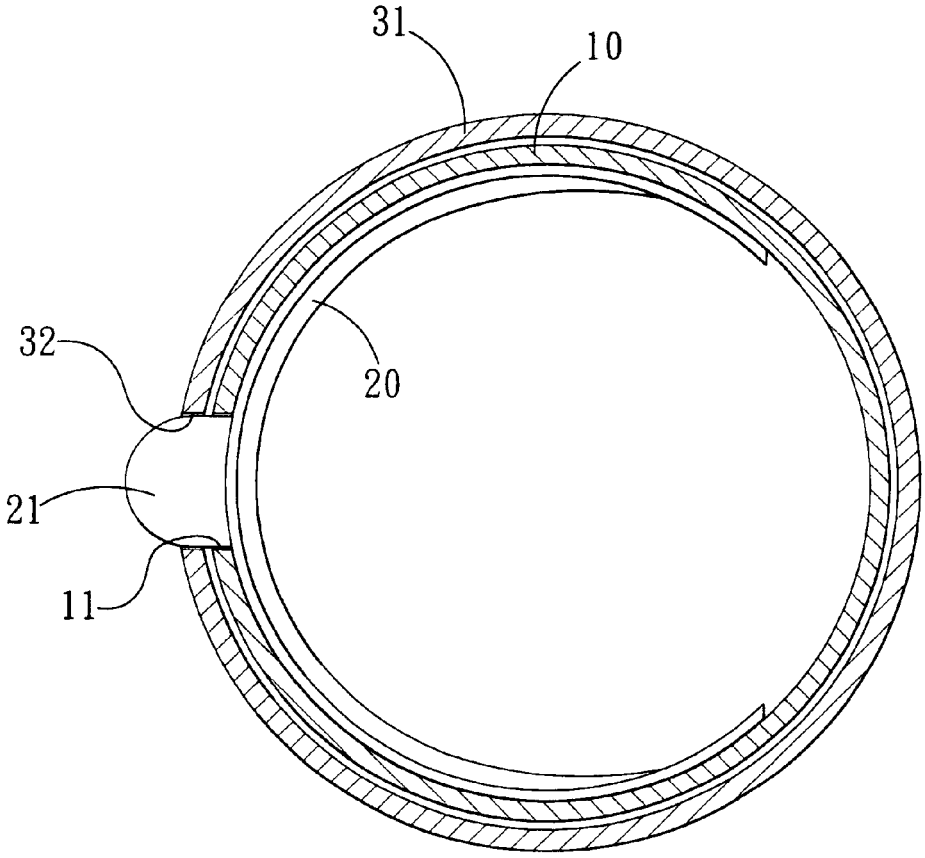
FIG. 3 is a top cross sectional view to show the protrusion of a connection member extends through aligned holes of two parts of the frame assembly of the present invention.

Referring to FIGS. 1 to 3, the frame assembly of the present invention comprises two top elbow members 30 and each of which has a horizontal extension tube 31 and a vertical extension tube 310. A first horizontal section 10 has two open ends and a first hole 11 is defined through a wall proximate to each open end of the first horizontal section 10. Each extension tube 31/310 has a second hole 32 defined through a wall thereof. The two open ends of the first horizontal section 10 is inserted in the two respective horizontal extension tubes 31 of the two top elbow members 30. The first holes 11 of the first horizontal section 10 are in alignment with the second holes 32 of the two respective horizontal extension tubes 31. Two connection members 20 are biased in the two open ends of the first horizontal section 10 and a protrusion 21 extends from each of the connection members 20. The protrusion 21 is inserted in the aligned first holes 11 and the second holes 32. It is noted that the distance between the two top elbow members 30 can be increased by connecting two or three first horizontal sections 10 and the connection members 20 are used to connect the first sections 10 head to tail by extending the protrusions 21 through the aligned first holes 11 of the first horizontal sections 10.

Two front elbow members 40 each have a horizontal extension tube 41 and a vertical extension tube 410. Each of the extension tubes 41, 410 has a third hole 42 defined through a wall thereof. Two first tubes 101 each have two open ends and a fourth hole 102 is defined through a wall proximate to each open end of the first tube 101. The two open ends of each of the first tubes 101 are inserted in the two respective vertical extension tubes 310, 410 of the top elbow member 30 and the front elbow member 40. The fourth holes 32 of the first tubes 101 are in alignment with the second hole 32 and the third hole 42 of the two respective vertical extension tubes 310, 410. Two connection members 20 are biased in the two open ends of each of the first tubes 101 and a protrusion 21 extends from each of the connection member 20. The protrusion 21 is inserted in the aligned second holes 32, the fourth holes 102 and the third holes 42.

Two rear elbow members 50 each have a first horizontal extension tube 51 and a second horizontal extension tube 510. Each of the two horizontal extension tubes 51, 510 has a fifth hole 52 defined through a wall thereof. A second horizontal section 103 has two open ends and a sixth hole 104 is defined through a wall proximate to each open end of the second horizontal section 103. The two open ends of the second horizontal section 103 are inserted in the two respective first horizontal extension tubes 51 of the two rear elbow members 50. The sixth holes 104 of the second horizontal section 103 are in alignment with the fifth holes 52 of the two respective first horizontal extension tubes 51. Two connection members 20 are biased in the two open ends of the second horizontal section 103 and a protrusion 21 extends from each of the connection members 20. The protrusion 21 is inserted in the aligned sixth holes 104 and the fifth holes 52.

Figure 6:
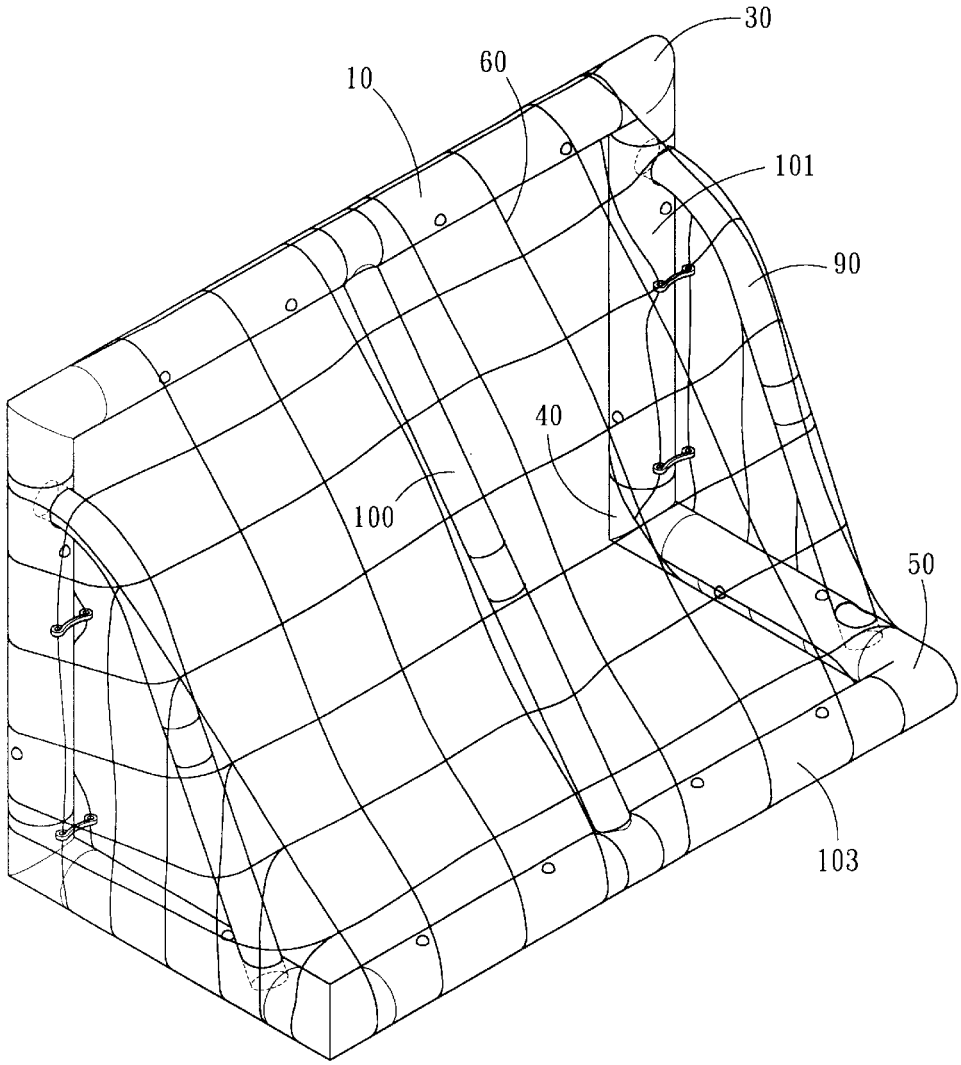
FIG. 6 is a perspective view to show a net is mounted to the frame assembly of the present invention.

Two second tubes 105 each have two open ends and a seventh hole 106 is defined through a wall proximate to each open end of the second tube 105. The two open ends of each of the second tubes 105 are inserted in the horizontal extension tube 41 of the front elbow member 40 and the second horizontal extension tube 510 of the rear elbow member 50. The seventh holes 106 of the second tubes 106 are in alignment with the third hole 42 of the front elbow member 40 and the fifth hole 52 of the second horizontal extension tubes 510. Two connection members 20 are biased in the two open ends of each of the second tubes 105 and a protrusion 21 extends from each of the connection member 20. The protrusion 21 is inserted in the aligned third holes 42 and the seventh holes 106, and the aligned fifth holes 52 and the seventh holes 106. Two protrusions 107, 1030 extend from the first horizontal section 10 and the second horizontal section 103 respectively. A central support bar 100 is connected between the two protrusions 107, 1030. The central support bar 100 can be a one piece member or be assembled by three sections by connection members 20 as the way that is described hereinafore. A net 60 is mounted to the frame as shown in FIG. 6 to become a goal frame of sport game.

Figure 4:
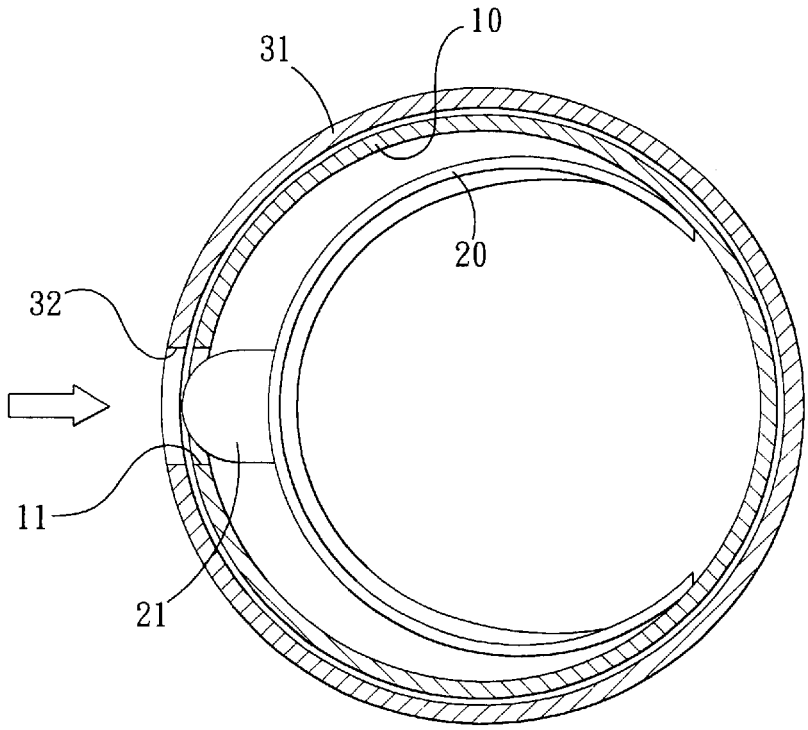
FIG. 4 is a top cross sectional view to show the protrusion is pushed inward the aligned holes of two parts of the frame assembly of the present invention.

Referring to FIG. 4, the protrusions 21 can be easily pushed inward to disengage from the holes that are defined in the outer tubes such that the inner tubes can be disengaged from the outer tubes conveniently and quickly.

Figure 5:
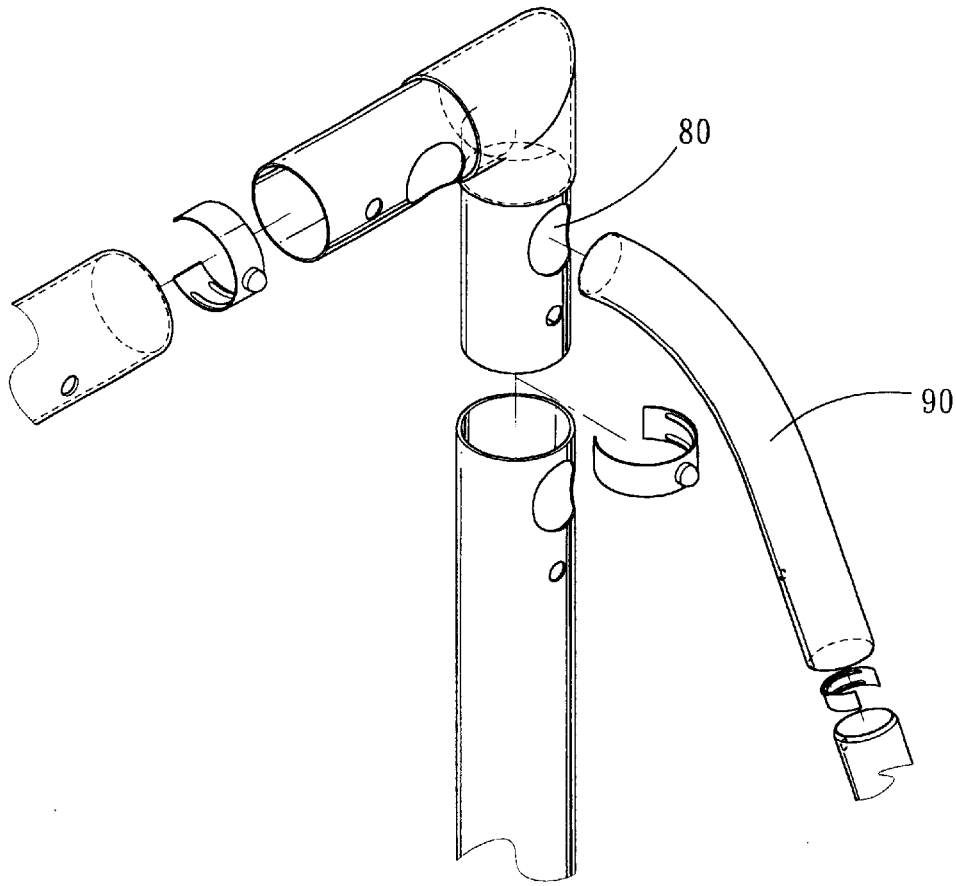
FIG. 5 shows a reinforcement bar is connected to the elbow member of the present invention.

Further referring to FIG. 5, each of the vertical extension tubes 310 of the top elbow members 30 and each of the second horizontal extension tubes 510 of the rear elbow members 50 has an engaging hole defined therein. Two reinforcement bars 90 are respectively connected between the top elbow member 30 and the rear elbow member 50 by engaging with the engaging holes 80. The length of the reinforcement bars 90 can be increased by connecting plural tubes by using the connection members mentioned above.

While we have shown and described the embodiment in accordance with the present invention, it should be clear to those skilled in the art that further embodiments may be made without departing from the scope of the present invention.

What is claimed is:

1. A frame assembly comprising:

a first horizontal section (10) having two open ends and a first hole (11) defined through a wall proximate to each open end of the first horizontal section (10);

two top elbow members (30) each having a horizontal extension tube (31) and a vertical extension tube (310), each of the extension tubes (31, 310) having a second hole (32) defined through a wall thereof, the two open ends of the first horizontal section (10) inserted in the two respective horizontal extension tubes (31) of the two top elbow members (30), the first holes (11) of the first horizontal section (10) being in alignment with the second holes (32) of the two respective horizontal extension tubes (31), two connection members (20) biased in the two open ends of the first horizontal section (10) and a protrusion (21) extending from each of the connection members (20), the protrusion (21) inserted in the aligned first holes (11) and the second holes (32);

two front elbow members (40) each having a horizontal extension tube (41) and a vertical extension tube (410), each of the extension tubes (41, 410) having a third hole (42) defined through a wall thereof, two first tubes (101) each having two open ends and a fourth hole (102) defined through a wall proximate to each open end of the first tube (101), the two open ends of each of the first tubes (101) inserted in the two respective vertical extension tubes (310, 410) of the top elbow member (30) and the front elbow member (40), the fourth holes (32) of the first tubes (101) being in alignment with the second hole (32) and the third hole (42) of the two respective vertical extension tubes (310, 410), two connection members (20) biased in the two open ends of each of the first tubes (101) and a protrusion (21) extending from each of the connection member (20), the protrusion (21) inserted in the aligned second holes (32), the fourth holes (102) and the third holes (42);

two rear elbow members (50) each having a first horizontal extension tube (51) and a second horizontal extension tube (510), each of the two horizontal extension tubes (51, 510) having a fifth hole (52) defined through a wall thereof, a second horizontal section (103) having two open ends and a sixth hole (104) defined through a wall proximate to each open end of the second horizontal section (103), the two open ends of the second horizontal section (103) inserted in the two respective first horizontal extension tubes (51) of the two rear elbow members (50), the sixth holes (104) of the second horizontal section (103) being in alignment with the fifth holes (52) of the two respective first horizontal extension tubes (51), two connection members (20) biased in the two open ends of the second horizontal section (103) and a protrusion (21) extending from each of the connection members (20), the protrusion (21) inserted in the aligned sixth holes (104) and the fifth holes (52), and two second tubes (105) each having two open ends and a seventh hole (106) defined through a wall proximate to each open end of the second tube (105), the two open ends of each of the second tubes (105) inserted in the horizontal extension tube (41) of the front elbow member (40) and the second horizontal extension tube (510) of the rear elbow member (50), the seventh holes (106) of the second tubes (106) being in alignment with the third hole (42) of the front elbow member (40) and the fifth hole (52) of the second horizontal extension tubes (510), two connection members (20) biased in the two open ends of each of the second tubes (105) and a protrusion (21) extending from each of the connection member (20), the protrusion (21) inserted in the aligned third holes (42) and the seventh holes (106), and the aligned fifth holes (52) and the seventh holes (106).

2. The frame assembly as claimed in claim 1, wherein each of the vertical extension tubes (310) of the top elbow members (30) and each of the second horizontal extension tubes (510) of the rear elbow members (50) have an engaging hole (80) defined therein, two reinforcement bars (90) respectively connected between the top elbow member (30) and the rear elbow member (50) by engaging with the engaging holes (80).

3. The frame assembly as claimed in claim 1 further comprising a central support bar (100) connected between the first horizontal section (10) and the second horizontal section (103).

4. The frame assembly as claimed in claim 3 further comprising two protrusions (107, 1030) extending from first horizontal section (10) and the second horizontal section (103) respectively, the central support bar (100) connected between the two protrusions (107, 1030).

* * * * *